United States Patent [19]

Spangler

[11] Patent Number: 5,005,544

[45] Date of Patent: Apr. 9, 1991

[54] ROCKER SHAFT SUPPORT SYSTEM FOR INTERNAL COMBUSTION ENGINE

[76] Inventor: Earl M. Spangler, R.D. #5 - Box 5066, Spring Grove, Pa. 17362

[21] Appl. No.: 475,914

[22] Filed: Feb. 6, 1990

[51] Int. Cl.[5] ..... F01L 1/18

[52] U.S. Cl. ..... 123/195 R; 123/193 H

[58] Field of Search ..... 123/90.41, 90.27, 195 R, 123/193 H, 193 CH, 90.39

[56] References Cited

U.S. PATENT DOCUMENTS

| | | | |
|---|---|---|---|
| 2,022,556 | 11/1935 | Brown | 123/195 R |
| 2,641,235 | 6/1953 | Slonneger | 123/90.39 |
| 2,908,262 | 10/1959 | Gropp | 123/90.39 |
| 3,200,804 | 8/1965 | Hensler et al. | 123/195 R |
| 3,584,612 | 6/1971 | Uflacker | 123/90.41 |
| 4,059,085 | 11/1977 | Mansfield et al. | 123/195 R |
| 4,538,561 | 9/1985 | Amemori et al. | 123/193 H |
| 4,612,885 | 9/1986 | Yoshikawa | 123/90.27 |
| 4,773,382 | 9/1988 | Smith, Jr. et al. | 123/193 H |

FOREIGN PATENT DOCUMENTS

| | | | |
|---|---|---|---|
| 2547992 | 5/1976 | Fed. Rep. of Germany | 123/193 H |
| 641137 | 1/1979 | U.S.S.R. | 123/90.39 |
| 280982 | 11/1927 | United Kingdom | 123/90.39 |
| 603634 | 6/1948 | United Kingdom | 123/90.39 |

*Primary Examiner*—Willis R. Wolfe
*Assistant Examiner*—T. Moulis
*Attorney, Agent, or Firm*—C. Hercus Just

[57] ABSTRACT

A system and method for reducing or eliminating the flexing of an engine rocker shaft at high RPM conditions. In one aspect of the invention, an elongated block stud is utilized in conjunction with a rocker shaft pillar mount to more securely hold the rocker shaft in position by having all forces transmitted to a block stud which is secured to the engine block. In a second aspect of the invention, a two-piece rocker shaft center support is utilized with the lowermost piece being secured to the cylinder head by a block stud threaded into the engine block. The rocker shaft thus is secured in position along its full length between each rocker arm no matter what cylinder head configuration is encountered.

20 Claims, 3 Drawing Sheets

FIG. 1
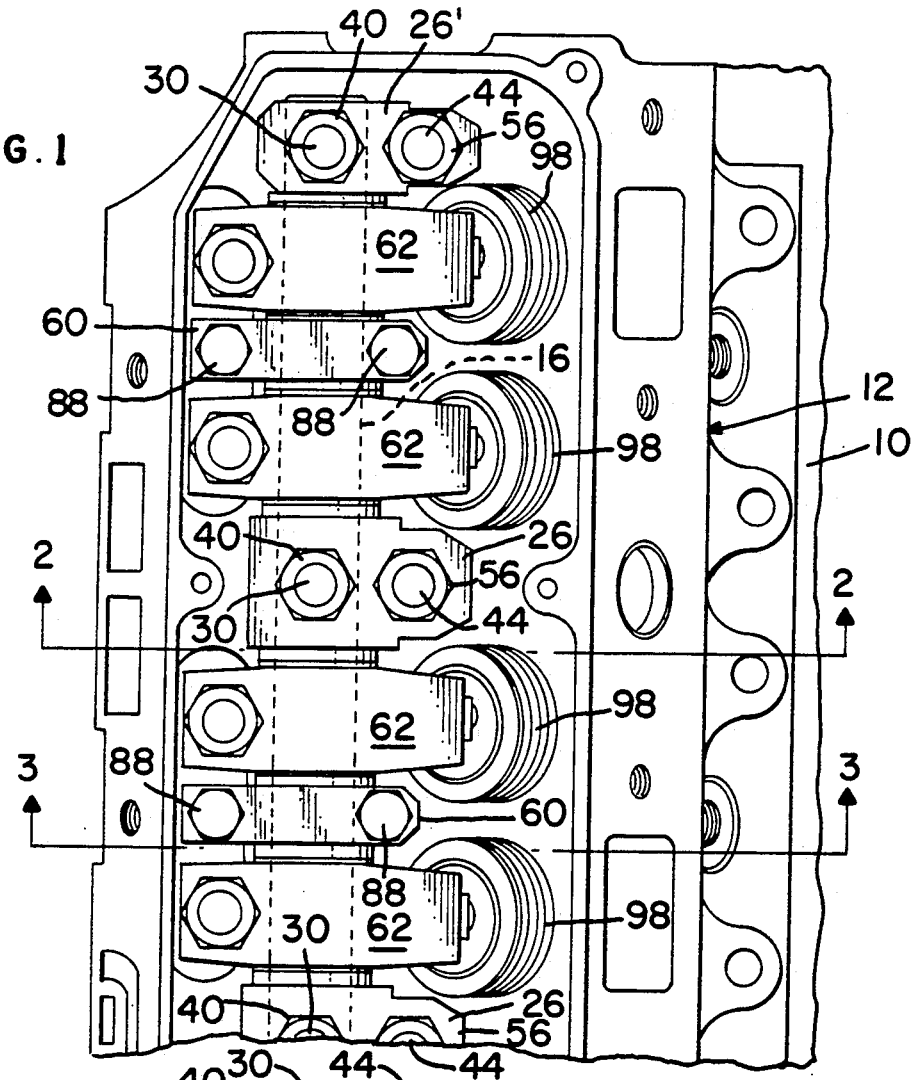
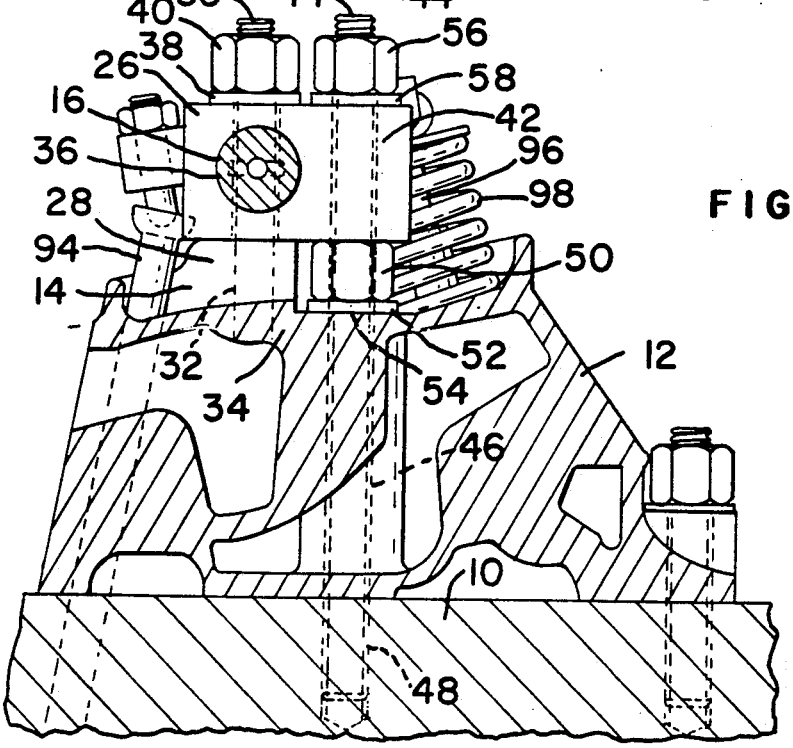
FIG. 2

ROCKER SHAFT SUPPORT SYSTEM FOR INTERNAL COMBUSTION ENGINE

BACKGROUND AND OBJECTS OF THE INVENTION

This invention is generally related to the internal combustion engine arts.

Specifically, the principles set forth herein are applicable to engines having a lower camshaft and pushrod configuration in conjunction with an upper rocker shaft location.

While the invention is specifically designed for modifying a Chrysler 440 or 340 C.I. engine, it will be appreciated by those of skill in the art that the described design has wide ranging utility in the engine arts.

It is known in the art that high-powered engines experience a significant loss of power at high RPM levels, i.e., on the order of 6,000–9,000 RPM. It now has been discovered in the development of the present invention that such high RPM power losses appear to be caused by cylinder head vibration or flexing which, in turn, is caused by flexing of the elongated rocker arm shaft at high RPM's. The elimination of the aforementioned high RPM power loss, in accordance with the present invention, therefore, comprises a major advance in the engine arts.

Accordingly, it is a principal object of the present invention to eliminate rocker shaft vibration and/or flexing at all engine operating levels, including high RPM conditions.

It is a further object of the invention to provide means wherein the elongated rocker shaft is more securely held in its intended position as contrasted with prior art systems.

It is also an object to provide a dual rocker shaft support system which readily is useable along cylinder heads of varying heights. The Chrysler 440 or 340 C.I. engine has such variable cylinder head height configurations as do other engines in the art.

Still another very important object of the invention is to provide supports for the rocker shaft between successive rocker arms on said shaft and, moreover, while said supports, in operation, are connected by studs to the cylinder block, they may be removed from said studs without disconnecting the combustion head from its attachment to said cylinder block, thereby preventing water leaks and the like.

These and other objects and advantages of the present invention will be apparent to those skilled in the art from the description which follows.

It has been known generally in the engine arts to utilize elongated bolts for the retention of rocker arm assemblies. However, the specific and advantageous structure of the present invention has not heretofore been demonstrated in the art.

PRIOR ART PATENTS

The most closely related prior art patents currently known to be pertinent to the present invention herein described are listed as follows:

U.S. Pat. No. 3,200,804 - Hensler, issued Aug. 17, 1965; U.S. Pat. No. 3,584,612 - Uflacker, issued June 15, 1971; and U.S. Pat. No. 4,612,885 - Yoshikawa, issued on Sept. 3, 1986.

The Hensler and Uflacker patents listed above show elongated bolt usages in conjunction with multiple rocker shaft engine designs. They do not, however, teach the elongated rocker shaft retention of the present invention. Nor do they teach the specific design of the present invention which utilizes a dual rocker shaft support system to account for the varying cylinder head heights of a high performance engine.

The Yoshikawa patent is related to overhead cam engines and teaches elongated bolt usages for the retention of intake and exhaust cam shafts. The Yoshikawa patent is not concerned with rocker shaft flexing which now has been discovered to be an apparent cause of power loss at high engine RPM.

BRIEF DESCRIPTION OF THE DRAWINGS

FIG. 1 is a fragmentary plan view of a typical cylinder head and block upon which supports for the rocker shaft are secured by studs to the cylinder block.

FIG. 2 is a vertical sectional view of the cylinder head and block taken on the line 2—2 of FIG. 1.

DETAILED DESCRIPTION OF THE PREFERRED EMBODIMENTS

Figure 4:
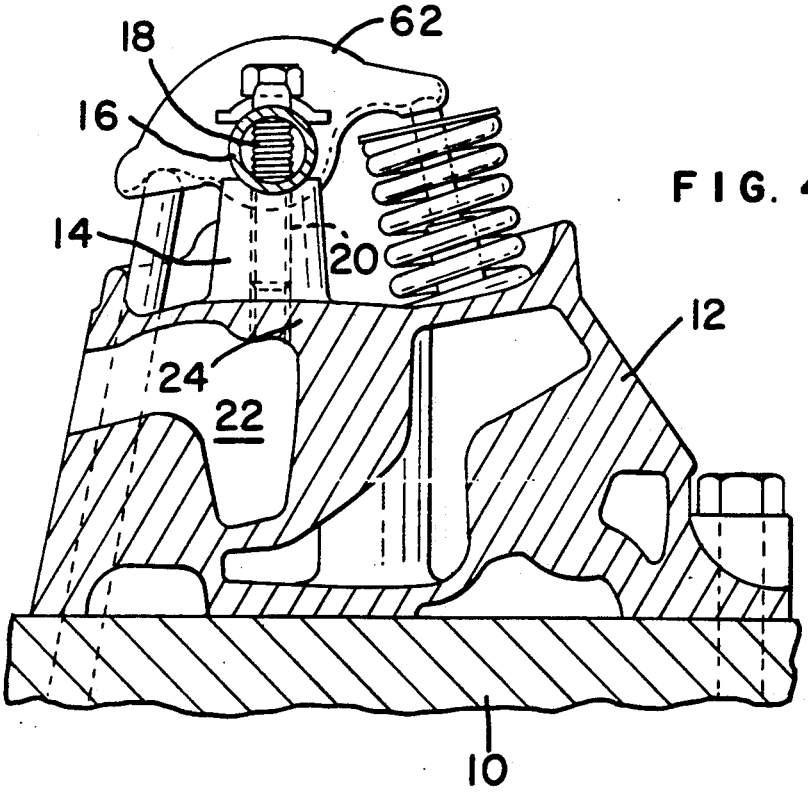
FIG. 4 is a vertical sectional view of the cylinder head and block of a conventional engine not adapted for high speeds and highlighting, by contrast, the changes afforded by the present invention.

To provide a basis for the description of the present invention and especially to contrast it with conventional engine construction which is adapted to be modified to incorporate the present invention therein, attention is directed to FIG. 4 of the drawings in which an exemplary internal combustion engine is shown of a Chrysler 440 or 340 C.I. engine. In said figure, it will be seen that a cylinder block 10 is shown fragmentarily and upon which a sectional view of a combustion head 12 is mounted. Extending upward from the upper portion of combustion head 12 is a pillar mount 14 upon which a typical conventional rocker shaft 16 is supported and a threaded bolt 18 extends through a suitable aperture in the shaft 16 for threaded engagement with a bore 20 in the pillar mount 14.

At least certain sections of the combustion head 12 have internal cavities 22 for purposes of receiving cooling liquid and, as shown in FIG. 4, the section shown therein is evidence of a weakened portion 24 above which the pillar mount 14 extends to support rocker shaft 16. With this condition in mind, it can be seen that especially when an engine of this type is operated at very high speeds, such as those encountered in racing cars, the relatively weak support for the rocker shaft 16 induces flexing and vibrations in the shaft and the rocker arms 62 which are mounted thereon, thereby causing loss of power and erratic operation of the engine. The present invention primarily modifies the conventional construction shown in FIG. 4 in a manner best shown in sectional views in FIGS. 2 and 3, which modified structure is adequate to eliminate such flexing and vibration of the rocker shaft 16, details of which are now to be described.

Figure 3:
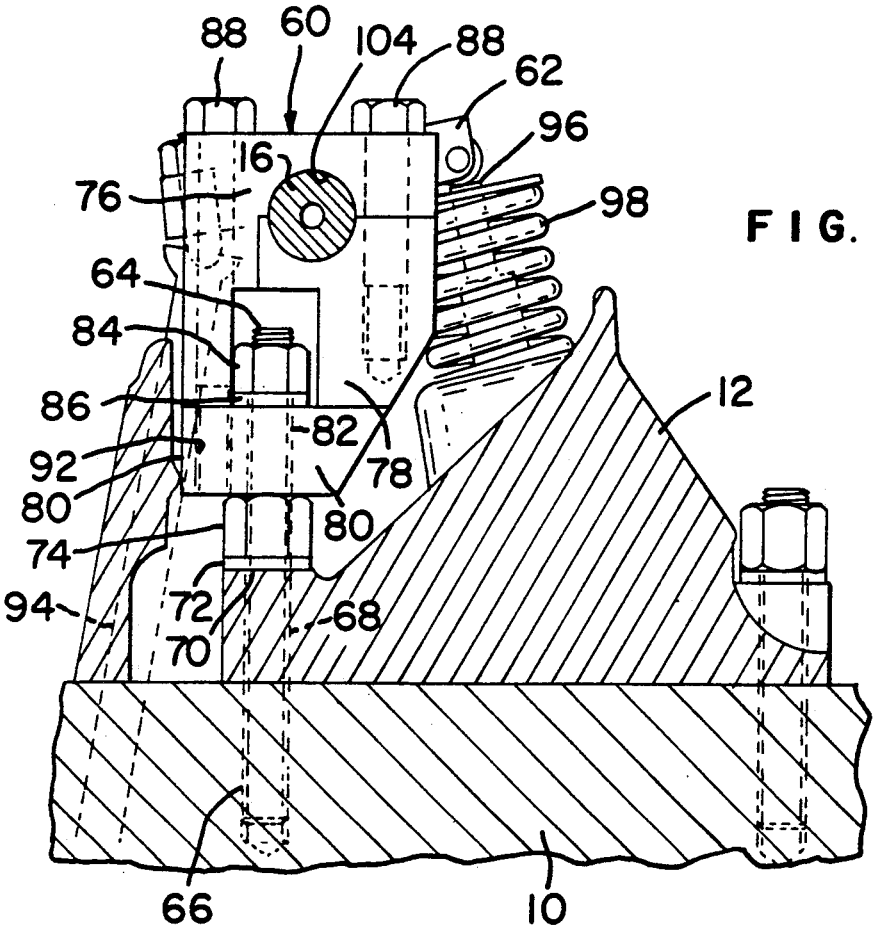
FIG. 3 is a vertical sectional view of the cylinder head and block taken on the line 3—3 of FIG. 1.

Referring to FIGS. 1, 2 and 3, which illustrate the essential details of the invention, particular attention is directed to FIG. 1, which comprises a fragmentary one-half of the combustion head 12 and cylinder block 10 of a V-type internal combustion engine. This figure adequately discloses the basic principles of the present invention which comprises the addition of specially designed supports for the rocker shaft 16, these supports respectively being illustrated in FIGS. 2, 3 and 5–7. It will be understood that in adapting supports for the rocker shaft 16 to various locations along the combustion head 12, the aforementioned different sizes of mounts are required in order for the same to be supported suitably upon the combustion head.

Referring to FIG. 2, there is illustrated therein a unitary type of support 26, which, for part of its support, rests upon a machined surface 28, which is the lower part of a pillar mount 14. A positioning stud 30, which is threaded, preferably for its full length, extends through a bore in the rocker shaft 16 and the lower end of it is threaded into a bore 32, as well as a continuation of said threaded bore into the casting 34 of the combustion head 12. The support 26 has a precise bore 36 therethrough which is very closely commensurate with the diameter of the rocker shaft 16 in order to form a precise fit therebetween.

Support 26 is firmly clamped against the machined surface 28 of pillar mount 14 by the use of a washer 38 and a nut 40, which is tightened against the washer and support to form part of the securing means for the latter with respect to cylinder block 10. Additional support is afforded by providing an additional bore 42 in support 26 through which an elongated threaded stud 44 extends, the stud 44 having appreciable length and extending through a bore 46 in the combustion head 12 and, finally, is threaded into a threaded bore 48 in cylinder block 10, thereby firmly clamping support 26 of the rocker shaft 16 with respect to the cylinder block 10.

One additional feature of the invention comprises an additional nut 50 which is threaded on stud 44 against a washer 52 which abuts a prepared machined surface 54 that is formed on the combustion head 12, said nut and washer 50 and 52 being applied before the mount 26 is placed in operative position with respect to the threaded stud 44. A further nut 56 is threaded onto the upper end of stud 44 against washer 58 and thereby firmly clamps the mount 26 with respect to the cylinder block 10.

Figure 5:
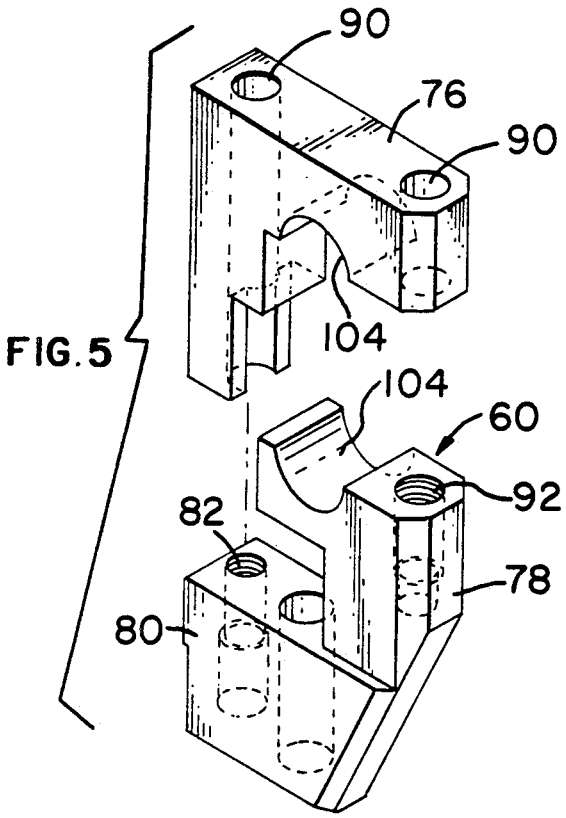
FIG. 5 is an enlarged perspective view of one of the supports of the present invention which is bipartite and the parts are shown in partially separated position.
Figure 6:
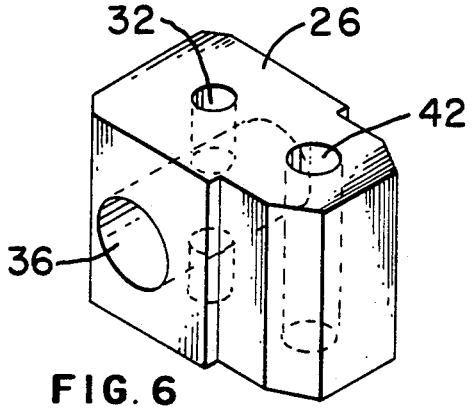
FIG. 6 is an enlarged perspective view of another support of the present invention which is unitary.
Figure 7:
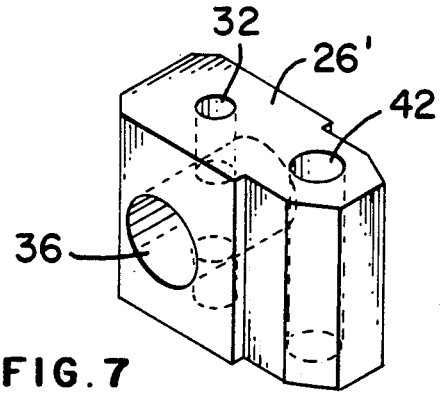
FIG. 7 is an enlarged perspective view of still another support of the present invention which is unitary but narrower in one dimension than the support shown in FIG. 6.
Figure 8:
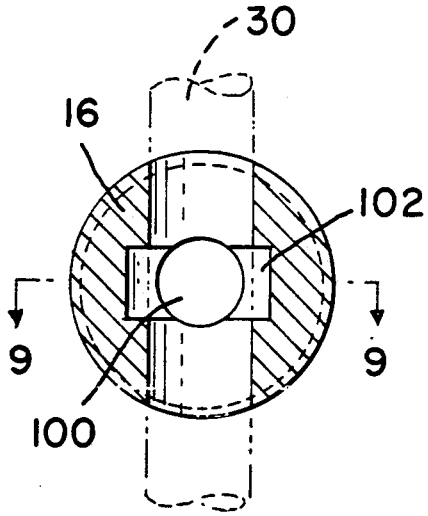
FIG. 8 is a fragmentary enlarged sectional view of the rocker shaft and a stud extending therethrough with adjacent oil passages.
Figure 9:
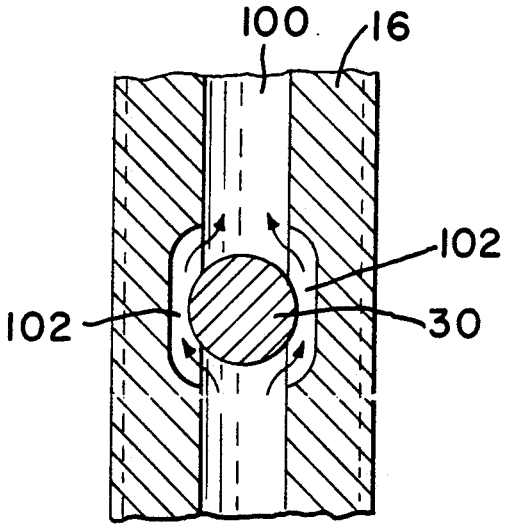
FIG. 9 is a sectional fragmentary view taken on line 9—9 of FIG. 8.

Referring to FIG. 3 wherein a different form of support is employed because of its location longitudinally along the combustion head 12, as shown in FIG. 1, the support 60, which is illustrated in detail in FIGS. 3 and 5, is bipartite. Referring to FIG. 1, it will be seen that supports of this type are positioned between each pair of rocker arms 62. Because of the nature of the casting comprising cylinder block 10 where the supports 60 are located, different securing means for such supports with respect to the same being firmly connected to combustion head 12 are employed. Referring particularly to FIG. 3, it will be seen that an elongated threaded stud 64 has the lower end thereof threaded into a threaded bore 66 in cylinder block 10 and extends upward therefrom through a bore 68 formed in the lower portion of the combustion head 12 and a machined surface 70 is formed on the combustion head 12 to receive a washer 72 and a nut 74, which is threaded onto the stud 64 and, when the nut 74 is tightened, it firmly connects the combustion head 12 to the cylinder block 10 and thereby prevents any leakage of water from the cooling system, even when the support 60 is detached from the engine, as in the case of the unitary support 26, shown in FIG. 2, when it is disconnected from the engine.

To adapt the bipartite support 60 to the rocker shaft 16 and because of the impossibility of extending the threaded stud 64 to a distance above the rocker shaft 16, it was found necessary to form the support 60 with an upper part 76 and a lower part 78, details of which are best shown in the exploded view shown in FIG. 5. The lower half 78 of support 60 has a lateral portion 80 on the lower portion of part 78, said lateral portion having a bore 82 extending therethrough through which the threaded stud 64 extends after the nut 74 has been tightened to clamp the combustion head firmly against the cylinder block 10. A nut 84 and washer 86 then are assembled upon the upper end of the threaded stud 64, thereby firmly clamping the lower part 78 of support 60 firmly against the tightened nut 74, thereby firmly connecting the lower part 78 of support 60 relative to the cylinder block 10.

Upper part 76 of the support 60 is firmly clamped against lower part 78 by means of threaded bolts 88, which respectively extend through suitable bores 90, see FIG. 5, and are threaded into threaded openings 92 in lower part 78 of support 60. The upper and lower parts 76 and 78 of support 60 also respectively are provided with one-half of a cylindrical opening 104 which accommodates the rocker shaft 16 for firm support thereof stationarily with respect to combustion head 12 by means of the various clamping arrangements described hereinabove.

All of the supports 26, 26′ and 60 are formed from heat-resistant aluminum in the preferred embodiments, one example of which is 70–75 T 6 aluminum. The rocker shaft 16 preferably is formed of high carbon steel, case hardened at its outer surface. The rocker arms 62 are of a rugged nature, highly capable of transmitting the force of pushrods 94, shown in phantom in FIGS. 2 and 3, to the valve stems 96 for purposes of compressing heavy duty type valve springs 98 which are substantially stronger than conventional valve springs used in standard engines not specifically adapted for racing purposes.

For purposes of distinguishing the various supports with respect to each other, it is considered that the supports 26 and 26′ are alternate supports and the intermediate supports 60 which are of a very narrow nature, are considered to be supports between said alternate supports, thereby defining terms used in the appended claims. Further, from FIG. 1, it will be seen that support 26 is wider in an axial direction of shaft 16 then supports 26′, especially in view of the fact that the rocker shaft 16 usually is of a continuous nature and since the supports 26 are between pairs of the rocker arms 62, more support for the rocker shaft at the location of supports 26 is needed than at the ends of the shafts where narrower shaft supports 26′ are sufficient for purposes of the invention.

Hereinabove, it has been indicated that the rocker shaft 16 has an axially-extending cylindrical opening 100 therein for the transmission of liquid lubricant. Particularly in the location, such as shown in FIG. 2, where threaded studs 30 extend through shaft 16, if no provisions were made for the flow of the lubricant past such studs, desired lubrication would not occur. Accordingly, the present invention includes opposite undercut passages 102 through which the lubricant bypasses the stud 30, whereby ample lubrication can be effected throughout the entire length of the rocker shaft 16.

From the foregoing, it will be seen that because of the effective firm anchoring of the various supports 26, 26' and 60 with respect to the combustion head and firmly and indirectly to said cylinder block, another advantage is made possible. It concerns the provision of changing the location of the bore in the several types of support for the rocker arm shaft which receive and support the same. Such variation of the position of said bore in the supports, in both horizontal and vertical directions with respect to the axis of the shaft, provides the possibility of variations in the geometry of the rocker arms, as well as valve lift, timing characteristics and the like. All of this is made possible without disturbing or changing the design of the cylinder block or the combustion head and the stud means for holding the two firmly connected; only changes in the design of the support are necessary.

In view of the foregoing, it is apparent that a relatively simple but highly advantageous support means for the rocker arm shaft are provided in several forms or embodiments, which render the rocker arm shaft free of any appreciable or detrimental flexing or vibration, whereby full power of the engine is produced, especially when operated at relatively high racing speeds, as well as at so-called normal speeds.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. In an internal combustion engine for racing cars adapted to be operated in relatively high RPM levels at which the rocker shaft of the engine supported upon the combustion head tends to flex or vibrate, the improvement comprising support means for said shaft upon the combustion head between each pair of rocker arms upon said shaft and including securing means which extend through the combustion head and into the cylinder block in which the pistons of the engine reciprocate and thereby secure said rocker shaft firmly to said cylinder block in a manner either to greatly reduce or eliminate said aforementioned vibration of said rocker shaft when said engine is operated at said relatively high RPM levels in racing cars when driven at high speeds.

2. The internal combustion engine according to claim 1 in which said securing means are stud bolts extending transversely through said supports through which said shaft extends and is supported thereby in stationary manner.

3. The internal combustion engine according to claim 2 in which alternate supports have openings transverse to said shaft and said shaft also has corresponding openings axially aligned therewith through which at least one of said stud bolts extends for threaded connection to threaded bores in said cylinder block.

4. The internal combustion engine according to claim 3 in which said supports between said alternate supports are bipartite and each part has mating partial openings through which said shaft extends for support and a pair of laterally offset openings respectively transverse to the axis of said shaft and arranged to receive clamping studs adjacent opposite sides of said shaft to secure the parts together and a stud bolt engaging one of said parts and threaded combustion head and engaging a threaded bore in said cylinder block to firmly clamp said supports to said block to prevent vibration of said shaft.

5. The internal combustion engine according to claim 4 in which said engine has a pair of rocker arms pivotally supported upon said shaft for each cylinder of said engine and said supports between said alternate supports are positioned between each pair of rocker arms for each cylinder, whereby each rocker arm is supported between one of said alternate supports and one of said supports between said alternate supports.

6. The internal combustion engine according to claim 4 in which said bipartite supports between said alternate supports each have one of a pair of semicircular openings between which said shaft extends for firm support thereby, the lower of said parts, considered when in use, having a lateral lower portion firmly clamped by a stud extending through the same and threaded into a threaded bore in the cylinder block, and the upper part being secured by a pair of stud bolts extending through aligned openings in said upper and lower parts respectively at opposite sides of said semi-circular openings, the openings in said lower part being threaded for engagement by said pair of stud bolts.

7. The internal combustion engine according to claim 3 in which said alternate supports are unitary and having a rocker shaft-receiving opening therethrough, said supports also having a pair of parallel bores therethrough transversely to said shaft-receiving opening, one of said parallel bores extending co-axially through said shaft and support to receive a stud which is threaded into said combustion head and the other parallel bore having an elongated stud extending therethrough and one end of said stud being threaded into said cylinder block.

8. The internal combustion engine according to claim 7 further having a nut threaded onto said stud and engaging an upper surface of said combustion head to stabilize said stud, said other parallel bore of said alternate support receiving said stud and abutting said nut, and a second nut engaging the upper end of said stud and top of said support, thereby firmly clamping said alternate support relative to said cylinder block.

9. The internal combustion engine according to claim 7 further characterized by said rocker has a central longitudinal opening therethrough for the transmission of liquid lubricant, and at the locations where said shaft has a transverse opening therethrough to receive said stud, the interior of the stud-receiving opening in said shaft is undercut at opposite sides of said opening to provide lubricant passages in said shaft without detracting from the clamping function of said studs.

10. The internal combustion engine according to claim 1 in which certain of said securing means are studs threadably connected to said cylinder block and having nuts threaded thereon in engagement with surfaces of said combustion head to secure the same securely in water-tight relation to said cylinder block to prevent water leakage regardless of the mounting of said supports upon said studs.

11. The internal combustion engine according to claim 10 in which certain of said studs are elongated and when said nuts are threaded thereon to engage said surfaces of said combustion head, said studs having sufficient additional length to project through and beyond openings in said supports and thereby accommodate an additional nut to engage and secure said support against said first mentioned nut.

12. The internal combustion engine according to claim 1 in which said support means are formed from high heat-resistant aluminum.

13. The internal combustion engine according to claim 12 in which 70–75 T6 aluminum comprises said support means.

14. The internal combustion engine according to claim 1 in which said rocker shaft is formed from high carbon steel having a case-hardened outer surface and a softer core.

15. A support for the rocker shaft of an internal combustion engine adapted to operate at high speeds and be connected to the cylinder block and combustion head of said engine for firm support of the shaft to prevent vibration and flexing under high speed operation, said support being bipartite and comprising a lower part provided with a lateral portion having a bore therethrough to receive a threaded stud extending transversely to said lateral portion and connectable to a threaded bore in said cylinder block, an upper part of said support connectable to said lower part by a pair of spaced threaded studs, said upper and lower parts having a cylindrical opening therethrough to receive said rocker shaft, one half of said opening respectively being in each of said parts, and a nut on the upper portion of said threaded stud clampingly engaging said lateral portion to secure it relative to said cylinder block..

16. The support for the rocker shaft of an internal combustion engine according to claim 15 wherein said threaded stud has appreciable length and said combustion head of said engine has a bore through which said stud extends from said cylinder block, a nut threaded upon said threaded stud to engage a surface on said combustion head to firmly clamp said head to said cylinder block, and said lateral portion of said lower part firmly rests upon said last mentioned nut for support and said nut upon the upper portion of said threaded stud firmly clamping said support upon said threaded stud.

17. A support for the rocker shaft of an internal combustion engine adapted to operate at high speeds and be connected to the cylinder block and combustion head of said engine, said support being unitary and having a transverse opening receiving said shaft for support thereof, said support also having a pair of substantially parallel bores extending in a direction perpendicular to said transverse opening, one of said bores extending diametrically through said opening for said shaft, a threaded stud extending through said one of said bores and the lower end being threaded into a bore in said combustion head, a threaded elongated stud extending through the other of said pair of bores and the lower end of said stud extending through a bore in said combustion head and the lower end of said stud being received in a threaded bore in said cylinder block, a nut threaded on said stud against a surface on said head to clamp it to said block, said support abutting said nut, and another nut engaging the upper end of said elongated stud to clamp said support firmly to said head and cylinder block.

18. The support according to claim 17 further characterized by said rocker shaft having a central longitudinal opening for transmission of liquid lubricant, and at least one side of said diametrical bore in said shaft through which said stud extends having a passage cut into said wall of said longitudinal opening to provide a bypass for said lubricant.

19. The support according to claim 18 in which opposite walls of said longitudinal opening have passages cut thereinto to provide bypasses for said lubricant.

20. An internal combustion engine having a cylinder block upon which a combustion head is positioned and including in combination:

(a) at least one threaded stud extending through a bore in said combustion head extending upward from the lower surface to an upper surface parallel thereto, (b) a nut threaded upon said upper surface to secure said combustion head firmly to said cylinder block, (c) a rocker arm shaft, (d) a support having a bore closely receiving said shaft for support thereof upon said head and an additional bore in said support transverse to said above recited bore adapted to receive said threaded stud, (e) and another nut threaded upon said threaded stud and abutting said support to clamp the same directly and firmly to said combustion head and indirectly to said cylinder block, thereby affording possibility of both vertical and horizontal adjustability for the location of said bore for said rocker arm shaft relative to said combustion head without changing the latter.

* * * * *